United States Patent [19]

Bez et al.

[11] Patent Number: 4,560,327

[45] Date of Patent: Dec. 24, 1985

[54] PORTING AND DUCTING ARRANGEMENT

[75] Inventors: Eckhard Bez, Moorabbin; John L. Farrant, North Balwyn, both of Australia

[73] Assignee: Commonwealth Scientific and Industrial Research Organization, Australia

[21] Appl. No.: 561,869

[22] Filed: Dec. 16, 1983

[30] Foreign Application Priority Data

Dec. 17, 1982 [AU] Australia ..... PF7323

[51] Int. Cl.[4] ..... F04B 37/14

[52] U.S. Cl. ..... 417/493; 417/498; 92/146; 92/61

[58] Field of Search ..... 417/493, 498; 137/625.3, 625.37; 92/146, 161; 91/24, 25, 189 R, 189 A, 191, 192, 449, 402, 357, 407, 408; 138/111; 123/65 W, 65 P; 239/556, 562, 563

[56] References Cited

U.S. PATENT DOCUMENTS

| | | | |
|---|---|---|---|
| 1,661,148 | 2/1928 | Winkler | 417/493 |
| 1,960,597 | 5/1934 | Schaer | 123/65 W |
| 2,223,759 | 12/1940 | Dillstrom | 417/493 |
| 2,260,113 | 10/1941 | Frost | 417/493 |
| 2,592,168 | 4/1952 | Morris et al. | 92/146 |
| 2,810,370 | 10/1957 | Fox et al. | 91/25 |
| 3,527,141 | 9/1970 | Peoples | 91/191 |
| 3,788,780 | 1/1974 | Chomczyk et al. | 417/493 |
| 4,363,296 | 12/1982 | Nightingale | 417/493 |

FOREIGN PATENT DOCUMENTS

| | | |
|---|---|---|
| 481072 | 5/1972 | Australia . |
| 20758 | 2/1976 | Australia . |
| AU82/128 | 2/1983 | PCT Int'l Appl. . |

*Primary Examiner*—Robert E. Garrett
*Assistant Examiner*—Richard S. Meyer
*Attorney, Agent, or Firm*—Sughrue, Mion, Zinn, Macpeak, and Seas

[57] ABSTRACT

A porting and ducting arrangement for a pair of adjacent hollow cylinders includes respective pluralities of passages extending longitudinally in the walls of the cylinders. Each passage is provided with a port in communication with the interior of the associated cylinder. Plural recesses in the end of the cylinders or in a cover are each in communication with a separate passage or group of passages when the cover is applied to the cylinders. There are a pair of such recesses thereby associated with each cylinder and at least one recess of each pair is in communication with a recess of the other pair via duct means in the cover. Gasket means is retained between the cylinders and the cover to seal each recess of each pair of recesses with respect to the other recess of the pair.

15 Claims, 6 Drawing Figures

PORTING AND DUCTING ARRANGEMENT

This invention relates to a porting and ducting arrangement for a pair of adjacent hollow cylinders. These cylinders may comprise or be part of a vacuum pump.

Australian patent Nos. 481072 and 516210, and international patent application No. PCT/AU82/00128, all in the name of the present applicant, disclose various forms of a reciprocatory piston and cylinder machine having a differential piston and two working spaces. In the practical application of this machine it is usual to provide multiple cylinders as respective stages of a multi-stage pump: the machine is particularly well suited to use as a mechanical vacuum pump utilising solid sealing rings or sleeves in lieu of oil or other liquid lubricant. A four-cylinder configuration having a pair of parallel-coupled high vacuum cylinders, jointly connected in series with a pair of medium and low vacuum cylinders, is particularly appropriate and has the advantage of being well-balanced. In pumps constructed to date, the connections between the stages have been made by cover passages and external conduits but these are not readily translated into an internal porting and ducting arrangement, especially because of the presence of two working spaces per cylinder. It is accordingly an object of the invention to provide a novel cylinder porting arrangement which may be conveniently applied, inter alia, to multiple stage vacuum pumps of the kind disclosed in the aforementioned patents and patent application.

The invention provides a porting and ducting arrangement for a pair of adjacent cylinders, comprising:

respective pluralities of passages extending longitudinally in the walls of the cylinders;

respective ports communicating the passages with the interiors of the cylinders;

a cover for the cylinders;

plural recesses each in communication with a separate said passage or group of said passages when the cover is applied to the cylinders, there being a pair of said recesses thereby associated with each cylinder and at least one recess of each pair also being in communication with a recess of the other pair via a duct means in the cover; and gasket means for retention between the cylinders and the cover to seal each recess of each said pair of recesses with respect to the other recess of the pair.

Preferably, the cover is provided with an opening in communication with said connected recesses for supplying or exhausting fluid to or from the interiors of the cylinders.

In one embodiment, both recesses of each pair are connected in communication with respective recesses of the other pair.

The recesses may be arcuate depressions formed in the ends of said cylinder walls, or, alternatively, depressions formed in the bottom surface of the cover, each in register with its respective separate passage or group of passages opening in the opposed ends of the cylinder walls.

The ports for those passages which are in communication with the connected recesses preferably open to the interior of the cylinders at respective intermediate positions so that each port is briefly uncovered by a piston reciprocating therein to permit intake of gas through the ports ahead of the piston. The other recess of each pair then communicates via a passage in the cover with an exhaust port in the cover communicable directly with the interior of the cylinder but normally fitted with a one-way exhaust valve. The ports associated with said other recess of each pair may open into an an annular working space within the interior of the cylinder behind said piston. There is thereby a valve-controlled connection between the exhaust port ahead of the piston and the annular working space behind the piston. This permits clearance of gas from the working space in front of the piston as the latter concludes its forward stroke and then, during the rearward stroke, compression of the whole exhaust side including the rear working space to the next stage or to a blow-off valve.

The invention will be further described, by way of example only, with reference to the accompanying drawings, in which.

Figure 1:
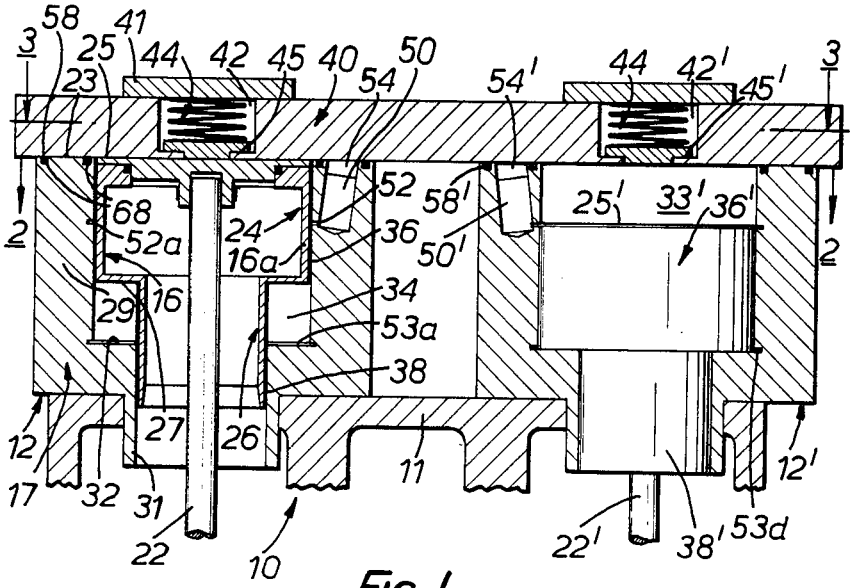
FIG. 1 is a bi-axial cross-section of a pair of cylinders for the high vacuum stage of a vacuum pump of the kind disclosed in international patent application No. PCT/AU82/00128, provided with a porting arrangement in accordance with a first embodiment of the invention and depicted with pistons in situ.

The two reciprocatory piston and cylinder units 12, 12' depicted in FIG. 1 are intended to be employed in parallel as the high vacuum stage 10 of a backing vacuum pump. Units 12, 12', mounted to a crankcase 11, are substantially identical and like parts are thus indicated by like reference numerals, primed in the case of unit 12'. Only unit 12 will be described in detail: it includes a piston 16 which is reciprocated by connecting rod 22 within a hollow metal cylinder 17. The detailed construction of cylinder 17 is not relevant for present purposes and is therefore not illustrated.

Figure 4:
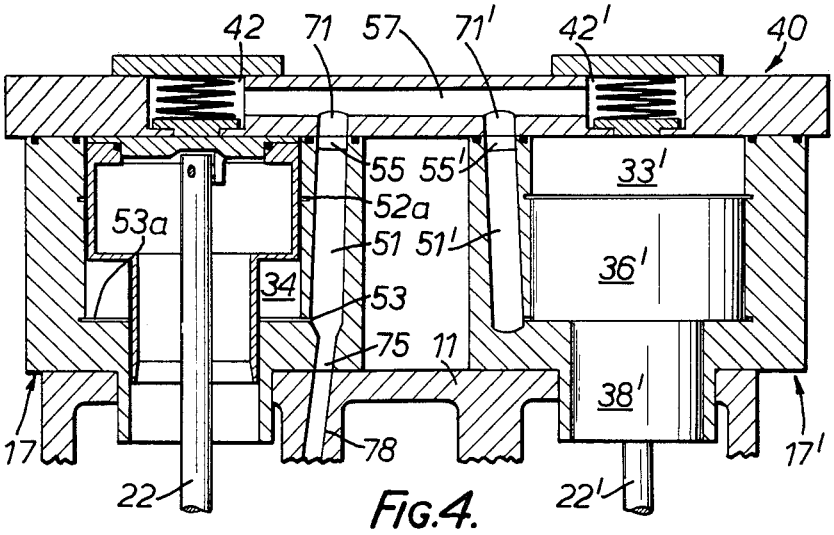
FIG. 4 is an angled cross-section on the diametral lines 4—4 in FIG. 2.

Piston 16 and cylinder 17 are both of stepped configuration. Piston 16, made up of a hollow body **16*a* and a cover 16*b*, has a relatively large diameter head portion 24 with an end face 25 defined by cover 16*b* and a smaller diameter rear skirt portion 26. An annular piston face 27 is thereby defined at the rear of head portion 24. Cylinder 17 has a relatively large diameter portion 29 with annular end face 23 within which the head portion 24 of the piston slides, and a portion 31 contiguous with, but of smaller diameter than, portion 29, to receive piston skirt portion 26. An annular shoulder 32 is defined by the cylinder between cylinder portions 29, 31 in opposition to the annular piston face 27. Thus, a differential piston arrangement is provided whereby the cylinder has a front cylindrical working space and a rear annular working space. In FIGS. 1 and 4 piston 16 is at top dead centre and piston 16' at bottom dead centre, and momentarily the only working spaces of significant volume are front cylindrical space 33' and rear annular space 34**.

The piston portions 24, 26 are provided with respective bronze-filled polytetrafluoroethylene (PTFE)

sleeves 36, 38 for substantially sealing the annular space between the piston portions and the respective cylinder portions 29, 31 in lieu of oil or other liquid lubricant. These sleeves, or similar, are disposed under circumferential and longitudinal tension on the cylindrical surfaces of the respective piston portions.

Figure 3:
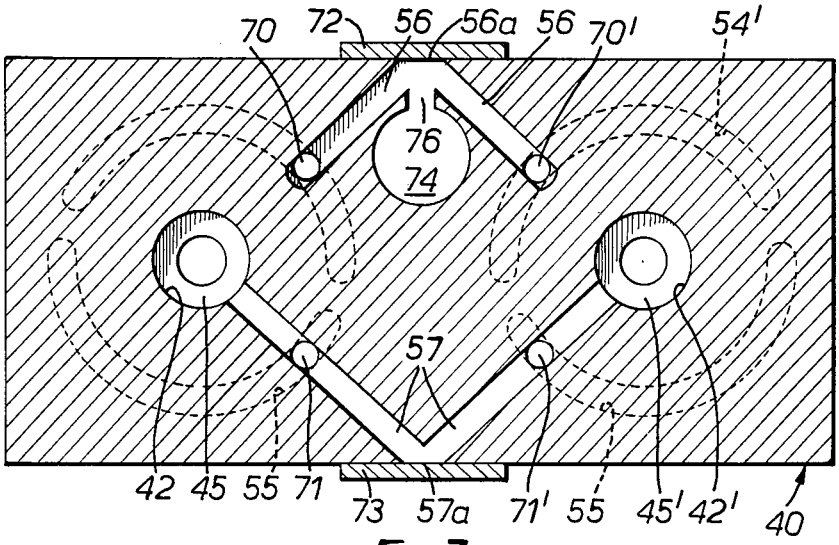
FIG. 3 is a cross-section through the head cover, on the line 3—3 in FIG. 1.

The two cylinders 17, 17' are bridged by a common, separable metal cover or head 40 for end faces 23, 23'. Cover 40 closes off the front cylindrical working spaces 33, 33' but is provided with respective stepped exhaust ports 42, 42'. Ports 42, 42' are closed by cover plates 41 and are fitted with one-way valves 44, 44' (FIG. 1) that seat on shoulders 45, 45' in the ports; these valves are not shown in FIG. 3 so as to avoid undue complexity in the drawings. The one-way valves prevent ingress of air to front working spaces 33, 33'.

The preferred porting arrangement in accordance with the invention includes plural longitudinal passages 50 (FIGS. 1 and 2), 51 (FIGS. 2 and 4) extending longitudinally parallel to the cylinder axes, but at a slight angle to the vertical, in the walls of each cylinder 17, 17'; respective ports 52 (FIG. 1), 53 (FIG. 3) communicating passages 50, 51 with internal grooves 52*a*, 53*a* open to the interiors of the cylinders, plural arcuate recesses 54, 55 in cylinder end faces 23; radially extending ducts 56, 57 (FIGS. 3 and 4) in cover 40, in a particular communication configuration with recesses 54, 55, 54' 55'; and a pair of unitary gaskets 58, 58' (best seen in FIG. 2) for retention between the cylinders 17, 17' and cover 40 to seal each recess of each pair of recesses with respect to the other recess of the pair.

The longitudinally extending passages are in two distinct sets. Passages 50 in cylinder 17, (50' in cylinder 17') comprise a set (five as shown) of arcuately spaced intake passages which communicate with the interior of cylinder 17 via ports 52 (FIG. 1) at an intermediate position so that the ports 52 are briefly uncovered by piston head portion 24 as it reciprocates, to permit intake of gas through the ports into the working space 33 ahead of the piston. In contrast, and for purposes which will become clearer in due course, the ports 53 (FIG. 4) for the passages 51 (51' in cylinder 17') of the other set (two as shown) open into the interior of the cylinder at a rearward extremity such that each port 53 opens into annular working space 34 behind the piston.

Figure 2:
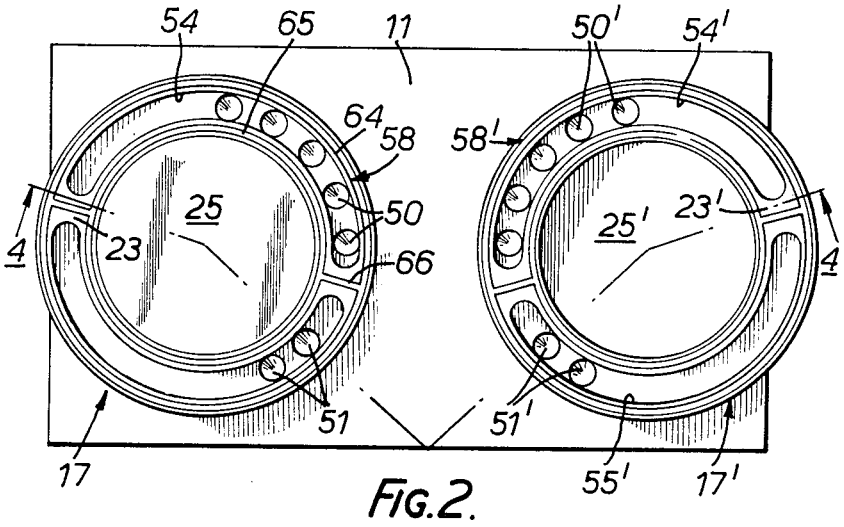
FIG. 2 is a plan view of the cylinders with the head cover removed, on the line 2—2 in FIG. 1.

Referring in particular to FIG. 2, recesses 54, 55 are so formed in the end faces 23 of the cylinders that each recess 54, 55, 54', 55' is in communication with the respective group of passages 50, 51, 50', 51'. A seal is provided about each of the four recesses by gaskets 58, 58' which each comprise a concentric pair of rings 64, 65 bridged by integral radial elements 66, the whole gasket being retained in a matching configuration of grooves 68 in the respective end face 23, 23' of the cylinder. It will be seen that the arcuate recesses 54, 55 are of a radial width slightly less than the separation of the rings 64, 65 of each gasket, and that the bridging elements 66 of each gasket are carefully positioned to sealingly separate the recesses and the sets of passages 50, 51.

Ducts 56 (FIG. 3) extend from a common opening 56*a* at one side of cover 40 to meet respective blind holes 70, 70' formed in the under surface of the cover to provide communication between the associated duct 56 and a respective recess 54, 54'. Ducts 57 symmetrically complement ducts 56 at the other side of the cover, having a common opening 57*a* and blind holes 71, 71', but they communicate with recesses 55, 55' and, moreover, are extended inwardly to meet exhaust ports 42, 42'. In the present application of the porting and ducting arrangement of the invention, openings 56*a*, 57*a* are closed off by plates 72, 73. Intake to ducts 56 is via a circular depression 74 in the top surface of cover 40, flow connected to the junction of ducts 56 by a lateral port 76. Exhaust from duct 57 is via a depending extension 75 of one of the passages 51.

Figure 6:
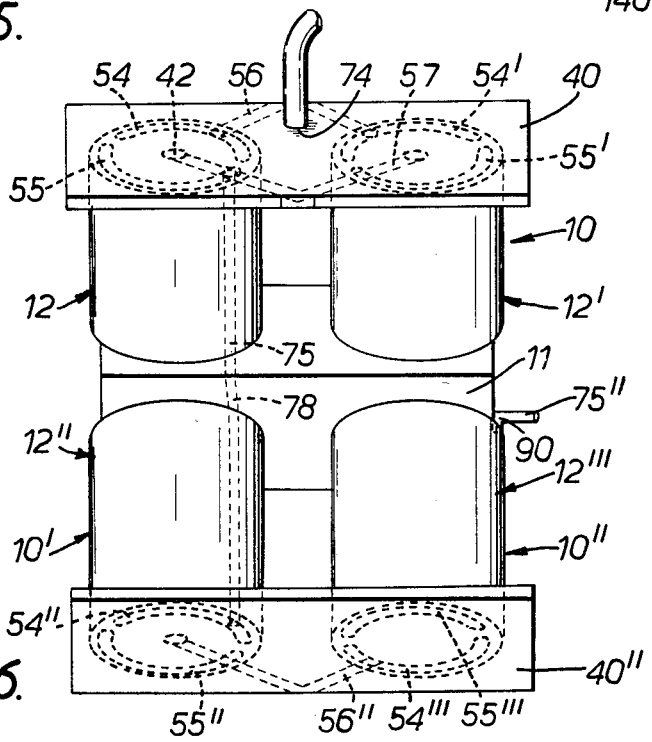
FIG. 6 is a schematic diagram of a four cylinder vacuum pump incorporating the invention.

As already indicated, the illustrated pair of units 12, 12' is intended to be employed in parallel as the high vacuum stage 10 of a four-cylinder vacuum pump. In a full assembly, depicted schematically in FIG. 6 (wherein like parts of each stage are indicated by like reference numerals, characteristically primed), an intake duct is coupled from the vessel to be evacuated to depression 74 in cover 40. Exhaust extension 75 is communicated to the third, intermediate vacuum stage 10', via a conduit 78 which passes obliquely through crankcase 11. The exhaust of cylinders 12'' stage 10' is connected to the intake of the fourth cylinder 12''', the low vacuum stage 10'', in turn exhausted at 75'' to atmosphere. The porting and ducting arrangement of the pair of cylinders 12'', 12''', is similar to that for cylinders 12, 12' save that there is only one cross-connection in the cover 40''—between an exhaust recess 55'' of cylinder 12'' and an intake recess 54''' of cylinder 12'''. A final one-way exhaust valve 90 opens from the rear annular space of cylinder 12'''.

In operation of the pump, pistons 16, 16' act in antiphase. At the lower end of the stroke of each piston, air is admitted to working space 33, 33' from the intake duct via depression 74, ducts 56, recesses 54, 54', longitudinal passages 50, 50' and ports 52, 52'. On the upward return stroke, this air is expelled through exhaust ports 42, 42'. On the downward stroke, the piston co-operates with the third stage (not shown) to transfer air from the exhaust space comprising working space 34, passages 51, 51', recesses 55, 55', ducts 57, and transfer passages 74, 79.

The described arrangement is an especially neat and compact approach to the porting of a pair of cylinders each having differential pistons and two working spaces.

Figure 5:
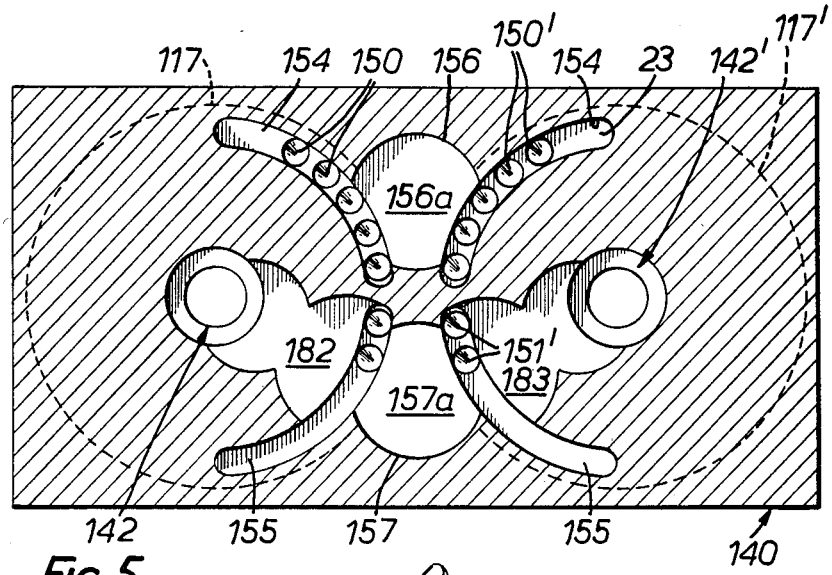
FIG. 5 is a view similar to FIG. 3, showing a porting arrangement according to a second embodiment of the invention.

FIG. 5 depicts an alternative duct configuration in a modified head 140 for cylinders 117, 117'. In this case, the arcuate recesses 154, 155 are provided in the bottom surface of the head, in register with passages 150, 151. Instead of ducts 56, 57, the cover is provided with a pair of upper annular openings 156, 157 in the top surface of cover 140, and radially directed shallow transfer passages 182, 183.

Openings 156, 157 serve two roles. Firstly, they are formed in the upper surface of cover 140 at a central position and to a sufficient depth to define cavities 156*a*, 157*a* which penetrate corresponding recesses 154, 154' and 155, 155' so that the recesses 154, 155 above cylinder 117 are in communication via cavity 156*a*, 157i a with respective recesses 154', 155' above the other cylinder 117'. Secondly, the openings 156, 157 may be readily connected to external components such as supply/exhaust lines. In addition, opening 157 is connected to exhaust ports 142, 142' by way of transfer passages 182, 183, which are formed by intersected segmental cuts extending from exhaust ports 142, 142' and from opening 157.

Openings 156, 157 are of maximum diameter consistent with the external dimensions of the cover to optimize communication with the respective connected sets of recesses 154, 154' and 155, 155' by minimizing impedance to airflow between the recesses and ducts or other components connected to openings 156, 157. This feature may be very helpful if the cylinders are to operate as, or as part of, a vacuum pump. A broad opening between cavity 156*a* and recesses 154, 154' will facilitate rapid air intake during the brief uncovering of ports 152.

It will be appreciated that the illustrated porting and ducting arrangements include many matters of detail not essential to the broad principles of the invention. Such matters of detail include the specific shapes and location of ducts, passages, ports and gasket means, the number and arrangement of longitudinal passages 50, 51, and the means by which these passages communicate with the interiors of the cylinders.

With respect to the gasket means, in place of the illustrated unitary gaskets, one might employ in each case a pair of sealing rings, one placed about one recess, the other about both recesses.

We claim:

1. A porting and ducting arrangement for a pair of adjacent hollow cylinders comprising:

a pair of adjacent hollow cylinders;

respective pluralities of passages extending longitudinally in the walls of the cylinders;

respective ports communicating the passages with the interiors of the cylinders;

a cover for the cylinders;

plural recesses each in communication with a separate one of said passages or group of said passages when the cover is applied to the cylinders with a pair of said recesses being associated with each cylinder and duct means in the cover communicating at least one recess of each pair with a recess of the other pair; and gasket means for retention between the cylinders and the cover to seal each recess of each said pair of recesses with respect to the other recess of the pair.

2. A porting and ducting arrangement according to claim 1 wherein the cover is provided with an opening in communication with said duct means for supplying or exhausting fluid to or from the interiors of the cylinders.

3. A porting and ducting arrangement according to claim 2 wherein said opening includes a depression formed in the top surface of the cover to a depth sufficient to communicate with the respective duct means, whereby such depression also provides a connection between said duct means.

4. A porting and ducting arrangement according to claim 1 wherein the said duct means comprises a pair of ducts extending in the cover radially in relation to the respective axes of the cylinders.

5. A porting and ducting arrangement according to claim 1 wherein said duct means communicates both recesses of each pair with respective recesses of the other pair.

6. A porting and ducting arrangement according to claim 5 wherein said duct means comprises a pair of ducts extending in the cover radially in relation to the respective axes of the cylinders.

7. A porting and ducting arrangement according to claim 1 wherein the recesses are arcuate depressions formed in the ends of said cylinder walls.

8. A porting and ducting arrangement according to claim 7 wherein said gasket means includes an integral gasket for each cylinder, comprising a pair of concentric rings substantially co-axial with the respective cylinder, which rings are integrally connected by plural bridging elements to separate the recesses.

9. A porting and ducting arrangement according to claim 1 wherein the recesses are depressions formed in the bottom surface of the cover, each in register with its respective separate passage or group of passages.

10. A porting and ducting arrangement according to claim 9 wherein said gasket means includes an integral gasket for each cylinder, comprising a pair of concentric rings substantially co-axial with the respective cylinder, which rings are integrally connected by plural bridging elements to separate the recesses.

11. A porting and ducting arrangement according to claim 1 wherein said gasket means includes an integral gasket for each cylinder, comprising a pair of concentric rings substantially co-axial with the respective cylinder, which rings are integrally connected by plural bridging elements to separate the recesses.

12. A porting and ducting arrangement according to claim 1 wherein the ports for those passages which are in communication with the recesses open to the interior of the cylinders at respective intermediate position's so that each port is briefly uncovered by a piston reciprocating therein to permit intake of gas through the ports ahead of the piston, the other recess of each pair then communicating via a respective passage in the cover with an exhaust port in the cover communicable directly with the interior of the cylinder but fitted with a one-way exhaust valve.

13. A porting and ducting arrangement according to claim 12, wherein the ports associated with said other recess of each pair open into an annular working space within the interior of the cylinder behind said piston, whereby there is a valve-controlled connection between the exhaust port ahead of the piston and the annular working space behind the piston.

14. A porting and ducting arrangement according to claim 12, wherein said recesses are connected by a pair of ducts extending in the cover radially in relation to the respective axes of the cylinders.

15. A porting and ducting arrangement according to claim 1, provided for each of two pairs of hollow cylinders in a four-cylinder vacuum pump, wherein the cylinders of one of said pairs are coupled in parallel to serve as the high vacuum stage when the pump is operating, while the other two cylinders are connected in series with each other and with the high vacuum stage and serve respectively as low and intermediate vacuum stages, one pair of said recesses in the high vaccum stage being in communication with a said recess of the intermediate stage via a duct joining respective said passages in the two stages.

* * * * *